US009714601B2

(12) United States Patent
Masuda et al.

(10) Patent No.: US 9,714,601 B2
(45) Date of Patent: Jul. 25, 2017

(54) VERTICAL-FLOW TYPE HEAT EXCHANGER HAVING A BAFFLE PLATE

(75) Inventors: Hideki Masuda, Komatsu (JP); Shuuhei Mizutani, Shimotsuke (JP)

(73) Assignee: Komatsu Ltd., Minato-ku, Tokyo (JP)

( * ) Notice: Subject to any disclaimer, the term of this patent is extended or adjusted under 35 U.S.C. 154(b) by 802 days.

(21) Appl. No.: 13/146,237

(22) PCT Filed: Jan. 20, 2010

(86) PCT No.: PCT/JP2010/000287

§ 371 (c)(1),
(2), (4) Date: Jul. 26, 2011

(87) PCT Pub. No.: WO2010/087128

PCT Pub. Date: Aug. 5, 2010

(65) Prior Publication Data

US 2011/0277979 A1 Nov. 17, 2011

(30) Foreign Application Priority Data

Jan. 27, 2009 (JP) ..... 2009-015716

(51) Int. Cl.
*F28F 9/02* (2006.01)
*F01P 11/02* (2006.01)
(Continued)

(52) U.S. Cl.
CPC ..... *F01P 11/028* (2013.01); *F28F 9/0214* (2013.01); *F28F 9/0231* (2013.01);
(Continued)

(58) Field of Classification Search
CPC ..... F28F 9/0204; F28F 9/0212; F28F 9/0278; F28F 9/0214; F28F 9/0231;
(Continued)

(56) References Cited

U.S. PATENT DOCUMENTS 1,344,351 A 6/1920 Norelius et al.
1,684,083 A * 9/1928 Bloom ..... 62/525
(Continued)

FOREIGN PATENT DOCUMENTS

DE 2840813 B1 * 1/1980 ..... F01P 11/02
FR 2478807 A1 9/1981
(Continued)

OTHER PUBLICATIONS

DE 2840813 B1 machine translation.*
(Continued)

*Primary Examiner* — Len Tran
*Assistant Examiner* — Gordon Jones
(74) *Attorney, Agent, or Firm* — Fish & Richardson P.C.

(57) ABSTRACT

A radiator as a heat exchanger of the invention includes: an upper tank into which a cooling water flows; a core in which fluid from the upper tank is heat-exchanged; and a lower tank that collects the fluid from the core. A baffle plate is provided inside the upper tank, the baffle plate dividing an inner space into a lower space and an upper space and provided with a communication opening that communicates between the lower space and the upper space. A bent portion bent toward the lower space is provided at each a longitudinal end of the baffle plate.

11 Claims, 4 Drawing Sheets

(51) Int. Cl.
*F28D 21/00* (2006.01)
*F01P 3/18* (2006.01)

(52) U.S. Cl.
CPC ..... *F01P 3/18* (2013.01); *F28D 2021/0094* (2013.01); *F28F 2265/18* (2013.01)

(58) Field of Classification Search
CPC ..... F28F 2265/18; F28D 1/05391; F28D 2021/0094; F25B 39/028; F01P 11/028; F01P 3/18
USPC ..... 165/174
See application file for complete search history.

(56) References Cited

U.S. PATENT DOCUMENTS 2,357,156 A * 8/1944 Wilson ..... 165/81
2,628,079 A * 2/1953 Haynes ..... F28F 9/0217 165/104.32
2,672,131 A * 3/1954 Wood ..... F01P 11/028 123/41.03
3,132,690 A * 5/1964 Suchomel ..... F01P 11/028 165/104.32
3,254,707 A * 6/1966 Ferguson ..... 165/110
3,282,333 A * 11/1966 Jensen ..... F28F 9/0231 165/111
3,447,602 A * 6/1969 Dalin ..... 165/145
4,002,442 A * 1/1977 Merz ..... F28F 9/0231 123/41.54
4,064,848 A * 12/1977 Pabst ..... F01P 11/029 123/41.51
4,394,141 A * 7/1983 Cadars ..... F28F 9/0226 165/148
5,592,830 A * 1/1997 Baba et al. ..... 62/509
5,934,367 A * 8/1999 Shimmura et al. ..... 165/174
5,941,303 A * 8/1999 Gowan et al. ..... 165/176
6,896,037 B2 * 5/2005 Leeson et al. ..... 165/44
7,275,394 B2 * 10/2007 Lundberg ..... 62/515
7,921,558 B2 * 4/2011 Beamer et al. ..... 29/890.043
8,146,652 B2 * 4/2012 Higashiyama et al. ..... 165/176
2001/0017201 A1 * 8/2001 Avequin et al. ..... 165/173
2001/0018970 A1 * 9/2001 Nakado et al. ..... 165/174
2004/0159121 A1 * 8/2004 Horiuchi et al. ..... 62/526
2006/0162918 A1 7/2006 Horiuchi et al.
2007/0012432 A1 * 1/2007 Hampel ..... 165/174
2007/0062678 A1 * 3/2007 Hayashi et al. ..... 165/176
2007/0144721 A1 * 6/2007 Watanabe et al. ..... 165/176
2007/0256821 A1 * 11/2007 Mashiko et al. ..... 165/160
2008/0023186 A1 * 1/2008 Beamer et al. ..... 165/174
2009/0173483 A1 * 7/2009 Beamer et al. ..... 165/173

FOREIGN PATENT DOCUMENTS

GB 473483 A * 10/1937 ..... F01P 11/028
JP S50-118557 U 9/1975
JP S55-38114 U 3/1980
JP S60-50387 U 4/1985
JP H05-096779 U 12/1993
JP H11-351787 A 12/1999
JP 2001-116486 A 4/2001
JP 2008-224213 A 9/2008

OTHER PUBLICATIONS

International Search Report mailed Mar. 16, 2010 in International Application No. PCT/JP2010/000287, 2 pages.
Office Action issued Aug. 13, 2013 in corresponding Japanese Application No. 2009-015716, including English translation, 4 pages.
Search Report issued May 6, 2014 in corresponding Supplementary European Patent Aplication No. 10735600.8, 5 pages.

* cited by examiner

VERTICAL-FLOW TYPE HEAT EXCHANGER HAVING A BAFFLE PLATE

CROSS REFERENCE TO RELATED APPLICATIONS

This application claims priority to Application No. PCT/JP2010/000287 filed on Jan. 20, 2010, which application claims priority to Japanese Application No. 2009-015716 filed on Jan. 27, 2009. The entire contents of the above applications are incorporated herein by reference in their entireties.

TECHNICAL FIELD

The present invention relates to a heat exchanger represented by, for instance, a radiator.

BACKGROUND ART

In a heat exchanger such as a radiator, an oil cooler and an intercooler (outer cooler), a heat exchanger structured to prevent air accumulation therein has been typically known (Patent Literatures 1 and 2).

Patent Literature 1 discloses a water-cooled intercooler. The water-cooled intercooler is structured such that a cross-sectionally arc-shaped groove bulging upward is provided on an upper surface of a casing into which cooling water flows and air in the casing is guided to a cooling-water inlet via the groove to be discharged outside from the cooling-water inlet.

Patent Literature 2 discloses a horizontal-flow type oil cooler. The oil cooler is structured such that a gap between a cap of a header pipe and a tube is made small so as to keep air from remaining in the header pipe, whereby air pool is not substantially generated in the gap.

CITATION LIST

Patent Literatures

Patent Literature 1 JP-UM-A-5-96779
Patent Literature 2 JP-A-2001-116486

SUMMARY OF THE INVENTION

Problems to be Solved by the Invention

In a radiator for engine-cooling water in a dump truck, when the dump truck is largely inclined toward either side thereof in travelling on a rough road, already-existing air pool in an upper tank of the radiator is inclined with a liquid surface of the engine-cooling water. Even with the structure of Patent Literature 1, air cannot be reliably guided to the cooling-water inlet. Moreover, even with the structure of Patent Literature 2, generation points of air bubbles are not constant because the liquid surface is inclined, so that generation of air pool cannot be completely prevented.

When the liquid surface of the cooling water is inclined in the upper tank, since a communication pipe communicating the upper tank and a core is exposed to the air pool, air in the air pool may be sucked into the core of the radiator through the communication pipe, so that heat exchange between the cooling water and outer air is not efficiently performed in the core.

An object of the invention is to provide a heat exchanger capable of efficiently performing heat exchange.

Means for Solving the Problems

In order to achieve the above object, a heat exchanger of the invention is not a heat exchanger structured to discharge outside air pool existing in the upper tank or inhibit such a generation of air pool, but a heat exchanger structured to securely prevent existing air pool from being sucked into the core even when a posture of the heat exchanger is largely changed. The heat exchanger will be described in detail as follows.

A heat exchanger according to an aspect of the invention includes: an upper tank into which fluid to be heat-exchanged flows; a core in which fluid from the upper tank is heat-exchanged; and a lower tank that collects the fluid from the core. A baffle plate is provided inside the upper tank, the baffle plate dividing an inner space into a lower space and an upper space and provided with a communication opening that communicates between the lower space and the upper space. A bent portion bent toward the lower space is provided at each longitudinal end of the baffle plate.

In the heat exchanger according to the above aspect of the invention, the bent portion is preferably inclined at a predetermined angle toward the lower space relative to a horizontal surface of the baffle plate.

Herein, "inclined at a predetermined angle" means "inclined in a range of acute angles relative to the horizontal surface.

According to the above aspect of the invention, when the heat exchanger is inclined, in the upper space where air pool is formed, air pool moves toward an upper side of the inclined upper space. With this arrangement, since the bent portion is provided at the end of the baffle plate, a volume of a space in which the air pool is to be formed is increased by the bent portion, whereby the air pool can be securely kept near the ends of the baffle plate and a lower side of the air pool can be kept away from covering the communication opening of the baffle plate. Consequently, this arrangement can eliminate separation of air bubbles from the air pool at the communication opening or sucking of separated air bubbles into the core, whereby decrease in cooling efficiency in the core can be prevented.

In the above aspect of the invention provided with the bent portion inclined at a predetermined angle, when the radiator is recovered from an inclined state to a horizontal state, or when a surface of a fluid is largely ruffled, splash-back of the fluid at the bent portion is inhibited to avoid circumstances such that air bubbles are easily separated from the air pool.

DESCRIPTION OF EXEMPLARY EMBODIMENT

An exemplary embodiment of the invention will be described below with reference to the attached drawings.

Figure 1:
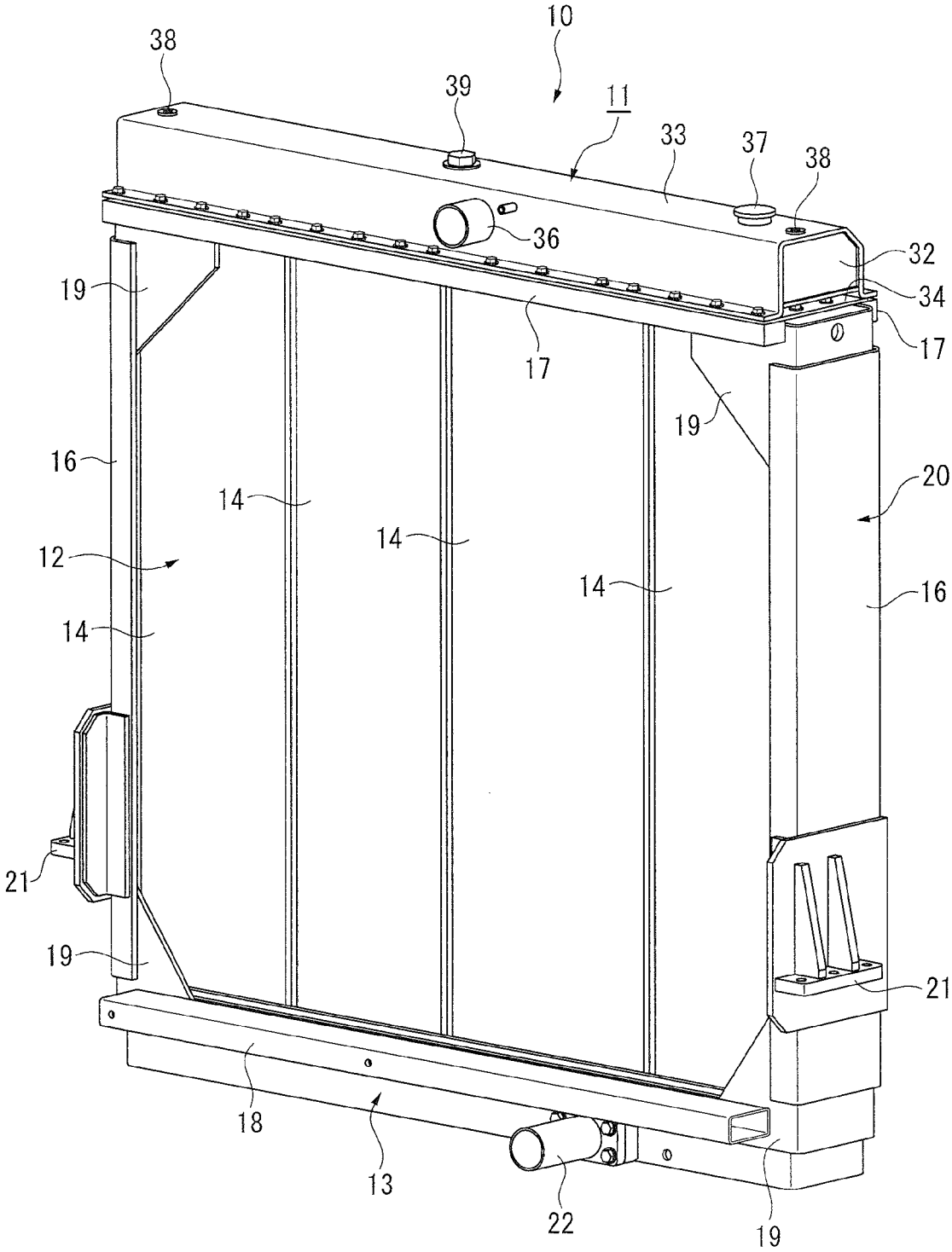
FIG. 1 is an overall perspective view showing a heat exchanger according to an exemplary embodiment of the invention.

FIG. 1 is an overall perspective view showing a radiator (a heat exchanger) 10 according to this exemplary embodiment. The radiator 10 cools cooling water (a fluid with which heat is exchanged) of an engine mounted on a large dump truck and the like. The radiator 10 of a vertical-flow type includes: an upper tank 11 into which the cooling water flows from the engine; a core 12 that cools the cooling water by heat exchange from the cooling water flowing from the upper tank 11 to outer air; and a lower tank 13 that collects the cooling water flowing from the core 12 and returns the cooling water to a water pump near the engine. The upper tank 11 will be described later.

In the exemplary embodiment, the core 12 consists of a plurality of module cores 14 (four module cores 14 in the exemplary embodiment) horizontally juxtaposed. Since the core 12 is extremely large, a single-unit structure of the core 12 causes difficulty in production. For this reason, in the exemplary embodiment, the core 12 is structured with a plurality of modularized module cores 14 for an easy production.

Similarly to a core used in a typical radiator, each of the module cores 14 is provided by, for instance, a corrugated core including a plurality of tubes for guiding the cooling water from the upper tank 11 to the lower tank 13 and corrugated fins interposed between the tubes.

The module cores 14 are housed in a four-piece frame 20. The frame 20 includes: a pair of vertical frames 16 on right and left sides; an upper frame 17 connecting upper ends of the vertical frames 16 respectively via brackets 19; and a lower frame 18 connecting lower ends of the vertical frames 16 respectively via brackets 19. Stays 21 for fixing the radiator 10 on a vehicle frame are respectively attached on lateral sides of the vertical frames 16.

The lower tank 13 is fixed to a lower surface of the lower frame 18 and is shaped in a box having an inner space communicated with the module cores 14. An outlet pipe 22 to which a radiator hose for returning the cooling water is connected is attached on a lateral side of the lower tank 13 facing the engine.

Figure 2:
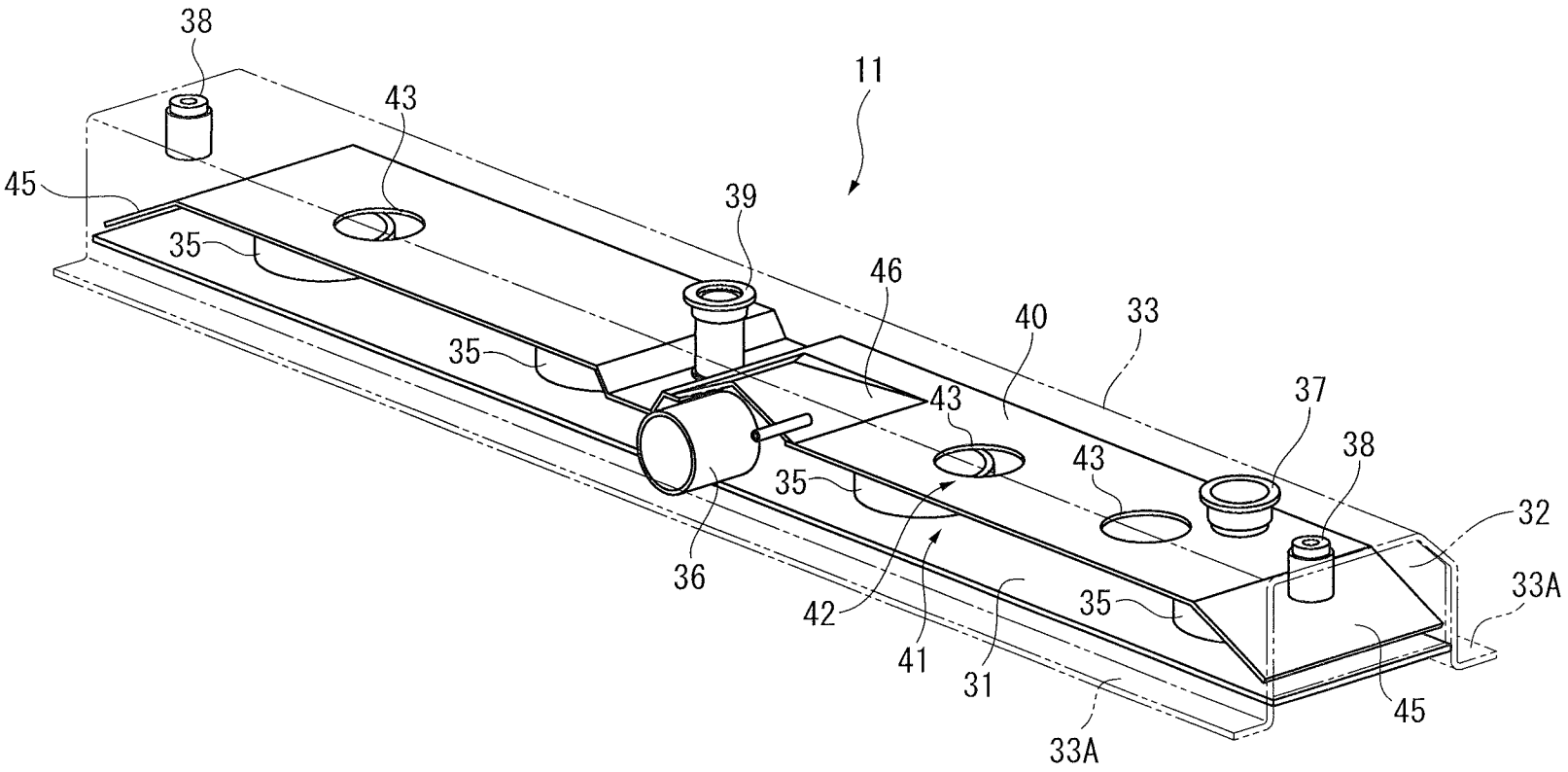
FIG. 2 is a partially transparent perspective view showing an upper tank of the heat exchanger.

FIG. 2 is a partially perspective view showing the upper tank 11. The upper tank 11 is box-shaped by a rectangular bottom plate 31, side plates 32 standing at either end of the bottom plate 31, and a cover plate 33 having a substantially square C-shaped cross section and covering the bottom plate 31 and the side plates 32. The upper tank 11 is bolted to the upper frame 17 of the frame 20 by using a flange 33A of the cover plate 33. A thin plate-shaped sheet member 34 (FIG. 1) is interposed in close contact between the flange 33A and the upper frame 17.

The bottom plate 31 is provided with communication pipes 35 disposed at positions corresponding to the module cores 14 (FIG. 1). Specifically, the module cores 14 are attached to a lower surface of the bottom plate 31. An inner space of the upper tank 11 and upper parts of the module cores 14 are communicated with each other by the communication pipes 35. The cooling water flowing in the upper tank 11 is distributed to the module cores 14 through the respective communication pipes 35.

An inlet pipe 36 to which a radiator hose for pouring the cooling water is connected is attached on a lateral side of the cover plate 33 facing the engine. A filler 37 for intake of water is attached to an upper surface of the cover plate 33 at an end thereof. Stud bolts 38 are attached to an underside of the upper surface of the cover plate 33 at either end thereof while being housed in the inner space thereof. A hook bolt for hanging the radiator 10 when the radiator 10 is mounted in a vehicle is screwed into each of the stud bolts 38. A mounting boss 39 of a sensor detecting a temperature and various states of the cooling water is centered on the cover plate 33.

A baffle plate 40 is welded inside the upper tank 11, the baffle plate 40 dividing the inner space in two, i.e., a lower space 41 and an upper space 42, along a longitudinal direction. When the cooling water flowing in the lower space 41 via the inlet pipe 36 contains air bubbles, the baffle plate 40 separates the air from the cooling water by moving the air bubbles to the upper space 42 and makes it difficult that the separated air bubbles returns to the lower space 41, thereby preventing the separated air bubbles from being sucked to the module cores 14 through the communication pipes 35.

Figure 3:
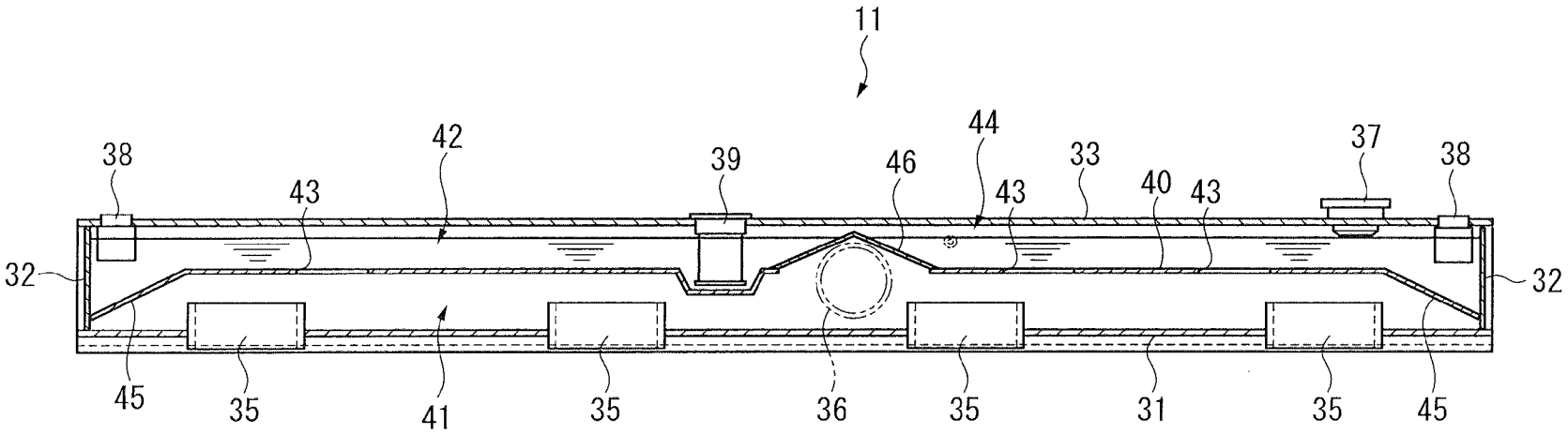
FIG. 3 is a cross sectional view showing the upper tank.

Accordingly, a plurality of communication openings 43 are provided at appropriate positions on a horizontal surface of the baffle plate 40 along a longitudinal direction thereof. The air bubbles (as well as the cooling water) moves from the lower space 41 to the upper space 42 through the communication openings 43. With such a structure, air pool 44 always exists in the upper space 42 as shown in FIG. 3. When the radiator 10 is in a horizontal state, the baffle plate 40 is positioned lower than the liquid surface of the cooling water except for a top of a roof 46 (later described).

A bent portion 45 is provided at each end of the baffle plate 40 in the exemplary embodiment. The bent portion 45 is bent and inclined toward the lower space 41 relative to the horizontal surface of the baffle plate 40. The bent portion 45 is bent at an angle enough not to interfere with the communication pipes 35 at each end of the baffle plate 40. As long as the angle is an angle at which the bent portion 45 does not interfere with the communication pipes 35, the bent portion 45 may be bent, for instance, at approximately 90 degrees. Since the bent portion 45 is structured as above, a volume in each of the ends of the upper space 42 is enlarged.

Figure 4:
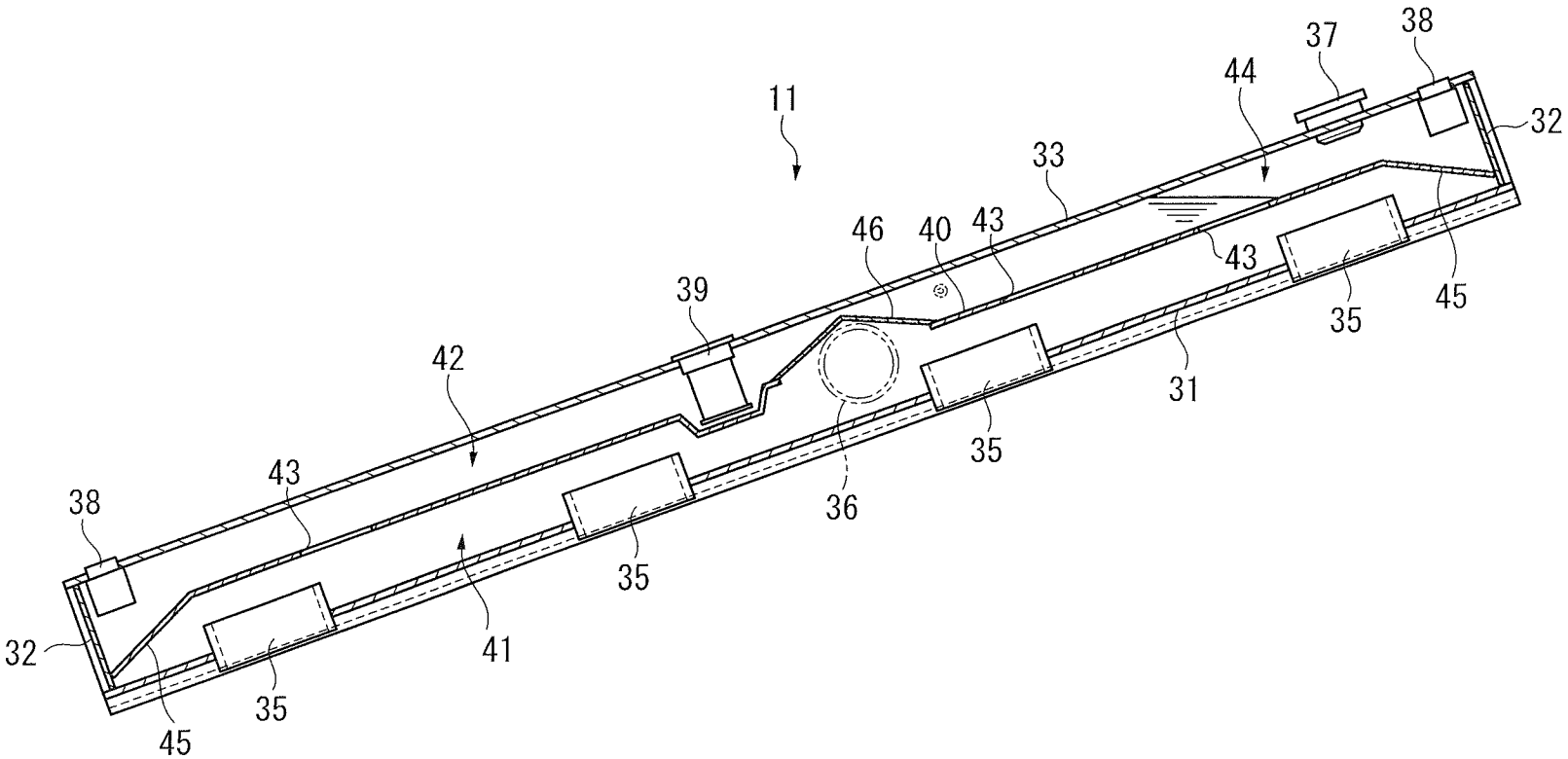
FIG. 4 is a cross sectional view showing a state where the upper tank is inclined.

A bending position and a bending degree of each of the bent portions 45 are also relevant to a desirable increase in a volume. When a vehicle travels on a rough road, the vehicle is inclined toward the left side or the right side, whereby the radiator 10 is also inclined. When the radiator 10 is inclined, as shown in FIG. 4, the air pool 44 is moved toward an upper side of the upper space 42 in the upper tank 11. At this time, when a volume at one of the ends of the upper space 42 (an upper end in this case) is small, a lower side of the air pool 44 covers one of the communication openings 43, so that air bubbles separated from the air pool 44 are likely to move into the lower space 41 through the communication opening 43 and to be drawn into the module core 14 through the communication pipe 35.

In such a state, since air bubbles reside in the tube of the module core 14, a flow of the cooling water is inhibited to decrease a cooling efficiency. In some cases, the air bubbles may reach a water pump to cause cavitation. Accordingly, it is required to prevent such sucking of air bubbles.

Specifically, in the exemplary embodiment, in order to prevent such sucking of air bubbles, the bent portion 45 is provided at the each end of the baffle plate 40 for increasing the volume of the upper space 42. With this arrangement, as shown in FIG. 4, even when the air pool 44 moves upward, air can be fully kept in a portion obtained by increasing the volume of the upper space 42 and the lower side of the air pool 44 is kept from reaching the communication opening 43.

In a state shown in FIG. 4, the radiator 10 is inclined at approximately 20 degrees. In the exemplary embodiment, however, even when the radiator 10 is inclined at 25 degrees, the volume of each of the ends of the upper space 42 is increased such that the lower side of the air pool 44 does not cover the communication opening 43, and the bending position and the bending angle of the bent portion 45 are designed so that the increased volume is secured.

With the above baffle plate 40, since the air pool 44 is kept from reaching the communication opening 43 even when the radiator 10 is inclined, separation of air bubbles from the air pool 44 is prevented and the air bubbles are kept from being drawn in the core 12, thereby inhibiting a decrease in the cooling efficiency.

Moreover, since the baffle plate 40 is provided, the cooling water entering from the inlet pipe 36 can smoothly be flowed to the module cores 14 without ruffling. Further, since the cooling water is kept from ruffling, air bubbles can be less likely to be mixed into the cooling water.

By providing the communication openings 43 near the center of the baffle plate 40, the air pool can be kept from reaching the communication openings 43 when the radiator 10 is inclined. However, when the communication openings 43 are provided only near the center, air bubbles in the poured cooling water may not be favorably guided to the upper space 42. For this reason, it is desirable to provide a plurality of communication openings 43 in a manner to separate from each other in a longitudinal direction of the baffle plate 40 as shown in the exemplary embodiment.

A vertical size of the upper tank 11 is reduced in view of a demand of downsizing an entirety of the radiator 10. On the other hand, the upper space 42 is required to have a predetermined volume so as to reliably obtain the air pool 44. For this purpose, it is required to lower a position of the baffle plate 40 and reduce a volume of the lower space 41 as much as possible.

Accordingly, in the exemplary embodiment, the roof 46 shaped in an upward convex to avoid interference with the inlet pipe 36 is positioned corresponding to the inlet pipe 36 of the baffle plate 40 and the inlet pipe 36 is positioned under the roof 46, whereby the entirety of the baffle plate 40 is lowered and the cooling water is securely flowed into the lower space 41.

Although the best arrangement and method to carry out the invention are disclosed in the above description, the invention is not limited thereto. In other words, while the invention has been particularly explained and illustrated mainly in relation to a specific embodiment, a person skilled in the art could make various modifications in terms of shape, quantity or other particulars to the above described embodiment without deviating from the technical idea or any object of the present invention.

Accordingly, any descriptions of shape or quantity or the like disclosed above are given as examples to enable easy understanding of the invention, and do not limit the present invention, so that descriptions using names of components, with any such limitations of shape or quantity or the like removed in part or whole, are included in the present invention.

For instance, in the exemplary embodiment, the bent portion 45 is provided at the end of the baffle plate 40. However, the bent portion 45 may be provided in such a manner as to be inclined as a whole from the center of the baffle plate 40 toward the ends thereof.

Although the bent portion 45 of the exemplary embodiment is shaped inclined, the bent portion 45 may be vertically bent as described above, or further, may be shaped in steps having a difference in level.

In the exemplary embodiment, the heat exchanger of the invention is exemplified by the radiator 10, but is not limited thereto. The heat exchanger of the invention may be an oil cooler and the like and may be applicable to any heat exchanger with an upper tank.

The invention claimed is:

1. A heat exchanger comprising:

an upper tank configured to receive fluid to be heat-exchanged;

a core configured to receive and heat exchange with the fluid from the upper tank;

a lower tank configured to collect the fluid from the core; and a baffle plate provided inside the upper tank, the baffle plate extending lengthwise along a longitudinal direction of the upper tank and dividing an inner space of the upper tank into a lower space and an upper space, wherein the baffle plate comprises (i) a horizontal surface extending in a longitudinal direction of the baffle plate and provided with a plurality of communication openings that are defined on the horizontal surface to fluidically communicate the lower space with the upper space, and (ii) bent portions, each of the bent portions continuously extending from respective ends of the horizontal surface in the longitudinal direction of the baffle plate and being bent from the ends of the horizontal surface to be inclined toward the lower space as extending away from the horizontal surface along the longitudinal direction of the baffle plate, wherein:

the heat exchanger comprises an inlet pipe coupled to a lateral side of the upper tank, a roof portion is defined on the horizontal surface at a portion corresponding to the inlet pipe, the roof portion having an upward convex shape and having a first end and an opposing second end in a width direction along a transverse direction of the upper tank, the roof portion protruding upwardly above a position of the communication opening in a vertical direction, and at least a lower half portion of the inlet pipe is positioned lower in the vertical direction than the horizontal surface of the baffle plate.

2. The heat exchanger according to claim 1, wherein each of the bent portions is inclined at a predetermined angle toward the lower space relative to the horizontal surface of the baffle plate.

3. The heat exchanger according to claim 1, wherein the inlet pipe is coupled to the lateral side of the upper tank that is closer to the second end of the roof portion along the transverse direction than to the first end of the roof portion.

4. The heat exchanger according to claim 1, further comprising an outlet pipe coupled to a lateral side of the lower tank.

5. The heat exchanger according to claim 1, wherein the plurality of communication openings are spaced along the longitudinal direction of the baffle plate.

6. The heat exchanger according to claim 1, wherein the core includes a plurality of modular cores.

7. The heat exchanger according to claim 6, wherein each of the plurality of modular cores includes a corrugated core having a plurality of tubes for guiding cooling water from the upper tank to the lower tank.

8. The heat exchanger according to claim 1, wherein each of the bent portions is bent about a line that extends widthwise along the transverse direction of the upper tank.

9. The heat exchanger according to claim 1, wherein the first end is inclined toward the lower space.

10. The heat exchanger according to claim 1, wherein the bent portions define a lower boundary of the upper space.

11. The heat exchanger according to claim 1, wherein an indent portion is defined on the horizontal surface of the baffle plate adjacent to the roof portion, the indent portion having a downward convex shape and protruding downwardly below the position of the communication opening in the vertical direction.

* * * * *